US010029303B2

(12) United States Patent
Yamamoto et al.

(10) Patent No.: US 10,029,303 B2
(45) Date of Patent: Jul. 24, 2018

(54) SLAB CONTINUOUS CASTING APPARATUS

(71) Applicant: SHINAGAWA REFRACTORIES CO., LTD., Tokyo (JP)

(72) Inventors: Kenji Yamamoto, Tokyo (JP); Yoshifumi Shigeta, Tokyo (JP); Mototsugu Osada, Tokyo (JP); Atsushi Takata, Tokyo (JP)

(73) Assignee: SHINAGAWA REFRACTORIES CO., LTD., Tokyo (JP)

( * ) Notice: Subject to any disclaimer, the term of this patent is extended or adjusted under 35 U.S.C. 154(b) by 0 days.

(21) Appl. No.: 15/124,194

(22) PCT Filed: Aug. 27, 2014

(86) PCT No.: PCT/JP2014/072462
§ 371 (c)(1),
(2) Date: Sep. 7, 2016

(87) PCT Pub. No.: WO2015/136736
PCT Pub. Date: Sep. 17, 2015

(65) Prior Publication Data

US 2017/0014898 A1 Jan. 19, 2017

(30) Foreign Application Priority Data

Mar. 13, 2014 (JP) ..... 2014-049931

(51) Int. Cl.
*B22D 11/103* (2006.01)
*B22D 41/56* (2006.01)
(Continued)

(52) U.S. Cl.
CPC ..... *B22D 11/103* (2013.01); *B22D 11/0401* (2013.01); *B22D 11/0408* (2013.01);
(Continued)

(58) Field of Classification Search
CPC ..... B22D 11/0401; B22D 11/0408; B22D 11/103; B22D 41/50; B22D 41/56
(Continued)

(56) References Cited

U.S. PATENT DOCUMENTS 4,632,283 A * 12/1986 Arakawa ..... B22D 41/42 222/600
5,482,192 A * 1/1996 Sato ..... B22D 41/34 222/600
(Continued)

FOREIGN PATENT DOCUMENTS

JP 62270261 A * 11/1987 ..... B22D 41/507
JP 63203259 A * 8/1988 ..... B22D 41/507
(Continued)

OTHER PUBLICATIONS

EPO machine translation of JP 62270261 A, Nov. 24, 1987.*

*Primary Examiner* — Kevin E Yoon
(74) *Attorney, Agent, or Firm* — Wenderoth, Lind & Ponack, L.L.P.

(57) ABSTRACT

The invention provides rotating a submerged nozzle during casting to arbitrarily change the discharge angle of molten metal, causing the molten metal in the mold for slab to be rotated and stirred. A slab continuous casting apparatus according to the invention supplies molten metal from a tundish to a water-cooled mold for slab through at least an upper nozzle, a slide valve and a submerged nozzle and solidified the molten metal and provided with a submerged-nozzle quick replacement mechanism. The slab continuous casting apparatus further includes a discharge-direction changing mechanism capable of arbitrarily changing discharge angle of the molten metal as viewed in a horizontal cross section, during casting, the discharge-direction changing mechanism being provided between a slide valve device
(Continued)

for opening and closing the slide valve and the submerged nozzle.

5 Claims, 11 Drawing Sheets

(51) Int. Cl.
*B22D 11/04* (2006.01)
*B22D 11/055* (2006.01)
*B22D 11/124* (2006.01)

(52) U.S. Cl.
CPC ..... *B22D 11/055* (2013.01); *B22D 11/1245* (2013.01); *B22D 41/56* (2013.01)

(58) Field of Classification Search
USPC ..... 164/437, 438; 222/591, 606; 266/236
See application file for complete search history.

(56) References Cited

U.S. PATENT DOCUMENTS

| | | | | |
|---|---|---|---|---|
| 5,811,023 | A * | 9/1998 | Hohenbichler | B22D 41/50 222/606 |
| 5,879,579 | A * | 3/1999 | Yoshino | B22D 41/56 222/606 |
| 7,108,046 | B2 * | 9/2006 | Kawano | B22D 41/56 164/437 |
| 8,490,841 | B2 * | 7/2013 | Yamamoto | B22D 41/22 222/591 |
| 2012/0175542 | A1 * | 7/2012 | Yamamoto | B22D 41/34 251/318 |

FOREIGN PATENT DOCUMENTS

| | | | |
|---|---|---|---|
| JP | 10211570 | A * | 8/1998 |
| JP | 2000263199 | A * | 9/2000 |

* cited by examiner

SLAB CONTINUOUS CASTING APPARATUS

TECHNICAL FIELD

The present invention relates to a slab continuous casting apparatus and, more specifically, relates to a novel improvement for rotating and stirring molten metal contained in a slab-use mold with the discharge angle of the molten metal arbitrarily changed during the casting process.

BACKGROUND ART

In recent years, ingots (referred to also as strands) of steel or various kinds of alloys or the like are mass-produced generally by using a so-called "continuous casting method" which includes the steps of continuously injecting a molten alloy or the like into a water-cooled mold and gradually drawing out solidified ingots out of the mold.

There is a history that practical use of continuous casting originated with continuous casting machines for billets and blooms and thereafter continuous casting of slabs having larger cross-sectional areas has increased because of strong demands for energy saving and productivity improvement.

In order to obtain high-quality ingots with less non-metallic inclusions and less component segregation by the above-described continuous casting, it is important to stir the molten metal in the middle of solidification as required. Also, stirring the molten metal in slabs which are larger in cross-sectional area and moreover larger in length-to-width ratio of the cross-sectional area (e.g., the ratio of the length of the longer side wall to the length of the shorter side wall being 5 or more) would be highly liable to such problems as occurrence of center segregation, center cross-sectional cracks as well as degradation of machinability, unlike the case of strands which are small in cross-sectional area and moreover nearly square in cross-sectional shape such as blooms or billets. For this reason, there has been a need for stirring the molten metal as required.

As a countermeasure of the technique of molten metal stirring in continuous casting, a method in which, for example, an electromagnetic stirrer is provided near a cooling mold or on a back face of a cooling mold and molten metal is stirred by utilizing electromagnetic force, is known. However, since the electromagnetic stirrers are quite expensive devices, there has been a demand for inexpensive devices substitutable for these electromagnetic stirrers, to stir molten metal in the cooling mold.

As a solution given by the above-described inexpensive devices, there is proposed such methods as Patent Documents 1 to 6 for blooms or billets having nearly square cross-sectional shapes.

Patent Document 1 discloses a method for generating a horizontal rotational flow in the molten metal within the mold by an arrangement that four discharge holes are provided in rotational symmetry in a lower portion of a submerged nozzle in a slant direction, more preferably an angle of (45±10)°, to a square mold plane. Although this method improved the quality of strands of blooms or billets, the extent of the effect was not sufficient. Therefore, Patent Document 2 improves Patent Document 1 and proposes a method for generating a horizontal rotational flow in the molten metal within the mold to stir the molten metal within the mold by inclining the direction of the molten metal discharged from four discharge holes so as to be along directions of constant angles relative to each mold surface of a square mold instead of being in rotational symmetry, i.e., toward directions corresponding to about a half of angles formed by a diagonal line relative to a normal extended from a submerged-nozzle center to individual side lines. Patent Document 2 describes that this method improved the quality of the strands. However, because these methods are assumed for bloom and billet molds, they have gained certain degrees of achievements by supplying the molten metal to both longer and shorter sides. With respect to slabs, there has been remaining an issue that molten metal can hardly be supplied up to the longer-side end face, making it impossible to obtain a sufficient stirring effect of the molten metal.

Patent Documents 3 to 6 propose methods for intending to stir the molten steel within the mold by injecting the molten steel into the mold with a rotatable submerged nozzle while it is rotated.

Patent Document 3 proposes a method for continuously rotating the submerged nozzle at a predetermined rotational speed by a drive device provided outside by rotatably supporting the submerged nozzle via a bearing, providing gaps at a lower end of a tundish nozzle and an upper end portion of the submerged nozzle and introducing inert gas to those gaps so that oxygen in the atmosphere is prevented from being captured into the molten steel through the gaps. As a result, Patent Document 3 describes that a horizontal rotational flow was generated to stir the molten steel within the mold, which improved the quality of strands.

Patent Documents 4 and 5 are improvements of Patent Document 3. Patent Document 4 proposes a method for continuously rotating the nozzle by reaction of the molten steel discharged through discharge holes of the submerged nozzle having circumferentially angled relative to radial directions from a center axis instead of using the drive device, in which the holding-and-rotating mechanism of the submerged-nozzle is identical to that of Patent Document 3. Patent Document 4 describes that the method for stirring the molten steel by rotating the submerged nozzle at a rotational speed corresponding to the flow velocity of the molten steel generated a horizontal rotational flow and stirred the molten steel within the mold to improve the quality of the strands. Further, Patent Document 5 proposes a method for efficiently stirring the molten steel by providing the discharge holes at different heights on the right and the left, injecting the molten steel into the mold at different heights, supporting the submerged nozzle rotatably, and continuously rotating the submerged nozzle at a predetermined rotational speed by a drive device. As a result, Patent Document 5 describes that a rotational flow was generated in horizontal and vertical directions to stir the in-mold molten steel, by which the quality of the strands was improved.

In these cases, there has been a problem that during the flow of the molten steel from the tundish nozzle to the submerged nozzle, pressure reduction occurs at the gap between the tundish nozzle and the submerged nozzle according to Bernoulli's principle, causing large amounts of inert gas to be blown into the molten steel through this gap with the result that large amounts of air bubbles are captured into the strands. On the other hand, although an effect was obtained in terms of molten steel stirring, in this case as well, there has been a problem, for application to slabs, that molten steel can hardly be supplied up to the longer-side end face, so that no effect enough to stir the molten steel can be obtained.

Meanwhile, Patent Document 6 proposes a twin-roll type continuous casting machine in which a flange is provided at the lower portion of the nozzle-extending part, the flange is put into sliding contact with a flange provided at the upper portion of the submerged nozzle, the flanges are pressed to each other by a spring or the like, and the submerged nozzle is continuously rotated at a predetermined rotational speed by providing a drive device. As a result, Patent Document 6 describes that wall shells were prevented from being generated by jetting the hot molten steel derived from the tundish uniformly in the mold so that the molten steel temperature in the mold is made to be uniform to improve the quality of the strands. However, if this method is applied to slab continuous casting machines for iron, there will be a problem of abrasion of the above sliding-contact portion. Although using solid lubricants or the like for ensuring lubrication property is conceivable of, it is not necessarily effective.

Further, in cases where the method for imparting a rotational flow to the molten steel within the mold by continuously rotating discharge directions such as Patent Documents 3 to 6 is applied to slab continuous casting machines, it would be difficult to supply molten steel to both longer side and shorter side parts, and particularly hard to supply molten steel to the longer-side end face, encountering a problem that sufficient stirring effect of the molten steel could not be obtained.

In contrast, Patent Document 7 provides a method for supplying molten steel to the longer-side end face concentratedly and stirring the molten steel smoothly in slab continuous casting machines by installing a submerged nozzle so that discharge directions of the molten steel by a two-hole submerged nozzle are set to between a normal extended from the center axis of the submerged nozzle to the mold shorter side and a diagonal line of the mold. Patent Document 7 describes that a molten steel continuous casting method was provided in which oversupply of discharge flows striking against the longer-side wall surface is eliminated and moreover breakouts are prevented so that ingots of excellent quality can be manufactured and the quality of the strands was improved.

On the occasion of continuous casting, continuing continuous casting with replacing a ladle filled with new molten steel while the molten steel stored in the tundish is taken as a buffer is referred to as sequential continuous castings (which means continuing continuous casting), and the number of ladles of the sequential continuous castings is referred to as number of sequential continuous castings. In this connection, increasing the number of sequential continuous castings is preferable from both energetics and economics points of view. However, the submerged nozzle for continuous casting is always submerged in the molten metal. Further, for ensuring lubricity between the solidified shell of steel and the water-cooled mold, oxide slags which are called as mold powder are formed in the water-cooled mold for continuous casting. Because the submerged nozzle has large dissolved loss at the portions contacting those oxide slags, there has been a problem that the number of sequential continuous castings cannot be increased. This problem is solved by replacing the submerged nozzle with new one as required during sequential continuous castings. The replacement of submerged nozzles in the middle of sequential continuous castings is referred to as quick replacement of submerged nozzles. For example, a quick replacement mechanism for submerged nozzles such as Patent Document 8 is introduced.

Even in such continuous casting machines having the quick replacement mechanism for submerged nozzles, it has been expected to stir the molten metal as required.

PRIOR ART DOCUMENTS

Patent Documents

[Document 1] Japanese Patent Application Laid Open No. S58-77754

[Document 2] Japanese Patent Examined Publication No. H1-30583

[Document 3] Japanese Patent Application Laid Open No. S62-259646

[Document 4] Japanese Patent Application Laid Open No. S62-270260

[Document 5] Japanese Patent Application Laid Open No. S62-270261

[Document 6] Japanese Utility Application Laid Open No. H1-72942

[Document 7] Japanese Patent Application Laid Open No. 2000-263199

[Document 8] Japanese Patent No. 4669888

SUMMARY OF INVENTION

Problems to be Solved by Invention

Because the conventional slab continuous casting apparatuses are constructed in manners described above, there are the following problems.

Specifically, the slab continuous casting apparatus of Patent Document 7 which overcomes the problems of the above-described slab continuous casting apparatuses of Patent Documents 1 to 6 also has the following problems.

Specifically, although inclusions are often deposited around discharge holes of the submerged nozzle during casting, the deposition positions are not necessarily symmetrical with respect to discharge directions. In case of asymmetric deposition positions, the directions of discharge flows often change relative to the initial setting directions during casting. Therefore, there has been a problem that a sufficient rotational flow cannot be obtained in the middle of casting. Further, recently, as the submerged nozzle or the like has longer lifespan, the service life of the submerged nozzle or the like has been able to endure casting with a plurality of ladles. As a result, it has been possible to sequentially cast strands of different kinds of steel or different widths of cooling molds. Although a method for performing continuous casting with changing the width or thickness of the mold during casting is often adopted, the method of Patent Document 7 has a problem that the optimum angle for obtaining a rotational flow of the molten metal cannot be ensured upon changing the width or thickness.

There has been a problem that attaching a submerged nozzle at a certain angle as the above cannot provide sufficient stirring effect for the molten metal from the middle of casting even though the sufficient effect can be provided in the initial stage of casting. With a submerged nozzle attached at a certain angle as shown above, there has been an issue that even if enough rotational flow is obtained in early stage, it may be impossible to obtain enough stirring effect for molten metal at some points on the way of process.

The present invention has been made in order to solve those problems and an object of the invention is to provide a slab continuous casting apparatus which is designed to perform a stable rotation and stirring of the molten metal in the slab mold particularly with arbitrarily changing the discharge angle of the molten metal during casting.

Means for Solving the Problems

A slab continuous casting apparatus according to the invention in which molten metal 3 is supplied from a tundish 1 to a water-cooled mold 2 for slab through at least an upper nozzle 4, a slide valve 5 comprising plate bricks 5*a*, 5*b*, 5*c*, and a submerged nozzle 10, and to which a submerged-nozzle quick replacement mechanism 20 is attached, wherein a discharge-direction changing mechanism 30 capable of arbitrarily changing a discharge angle of the molten metal 3 as viewed in a horizontal cross section, during casting, is provided between a slide valve device 8 for opening and closing the slide valve 5 and the submerged nozzle 10;

the discharge-direction changing mechanism 30 comprises: a sliding-contact surface 40 provided at least at an upper surface 10*a* of the submerged nozzle 10; a submerged-nozzle quick replacement mechanism 20; and a drive mechanism 70 for changing the discharge directions of the molten metal 3 from the submerged nozzle 10;

the submerged-nozzle quick replacement mechanism 20 comprises: bases 21; clampers 23 supported by clamper pins 62 provided on the bases 21; and springs 22 provided on the bases 21 to bias the dampers 23 upward, wherein the dampers 23 and the springs 22 are a binary mechanism opposed to each other so as to form an angle of 180°, and wherein the dampers 23 support a flange lower surface 25*a* of the submerged nozzle 10 inserted along guide rails 26, the clampers 23 being biased upward by the springs 22 whereby holding and pressing upward the submerged nozzle 10;

the drive mechanism 70 for changing the discharge directions of the discharge holes 10*b* of the submerged nozzle 10 comprises: a drive device 71 for applying force for changing the directions; and a transmission part 90 for transmitting the force from the drive device 71 to the submerged-nozzle quick replacement mechanism 20, and wherein the submerged-nozzle quick replacement mechanism 20 holding the submerged nozzle 10 is integrally swung leftward and rightward about a center axis of the submerged nozzle 10 by operating the drive device 71; and the upper surface 10*a* of the submerged nozzle 10 is in sliding contact with a lower surface 9*a* of a lower nozzle 9 located under the slide valve device 8 or in sliding contact with a lower surface of a lower plate 5*c* forming a part of the slide valve device 8.

Effects of Invention

Because the slab continuous casting apparatus according to the invention is constructed in a manner described above, it can provide the following effects.

Specifically, in a slab continuous casting apparatus supplying molten metal from a tundish 1 to a water-cooled mold 2 for slab through at least an upper nozzle 4, a slide valve 5 consisting of plate bricks 5*a*, 5*b*, 5*c*, and a submerged nozzle 10 and attaching a submerged-nozzle quick replacement mechanism thereto, by providing a discharge-direction changing mechanism 30 between a slide valve device 8 for opening and closing the slide valve 5 and the submerged nozzle 10, which can arbitrarily change the discharge angle of the molten metal 3 as viewed in a horizontal cross section during casting, a discharge flow 3*a* from the submerged nozzle 10 can be arbitrarily directed to a particular direction, a rotational flow can be imparted to the molten metal and moreover a proper discharge angle can be ensured upon changing the discharge angle due to the deposition of the inclusions to discharge holes or even changing the thickness and width of the mold.

Further, because the discharge-direction changing mechanism 30 includes a sliding-contact surface 40 provided at least at an upper surface 10*a* of the submerged nozzle 10, a submerged-nozzle quick replacement mechanism 20 and a drive mechanism 70 for changing the discharge direction of the molten metal 3 from the submerged nozzle 10, the rotation of the submerged nozzle is facilitated.

Further, the submerged-nozzle quick replacement mechanism 20 includes bases 21, dampers 23 supported by damper pins 62 provided on the bases 21 and springs 22 provided on the bases 21 to bias the clampers 23 upward, the clampers 23 and the springs 22 are a binary mechanism opposed to each other so as to form an angle of 180°, the dampers 23 support a flange lower surface 25*a* of the submerged nozzle 10 inserted along guide rails 26, the clampers 23 are biased upward by the springs 22 whereby holding and pressing upward the submerged nozzle 10. The drive mechanism 70 for changing the discharge directions of the discharge holes 10*b* of the submerged nozzle 10 includes a drive device 71 for applying force to change the directions and a transmission part 90 for transmitting the force from the drive device 71 to the submerged-nozzle quick replacement mechanism 20, and the submerged-nozzle quick replacement mechanism 20 holding the submerged nozzle 10 is integrally swung leftward and rightward about a center axis P of the submerged nozzle 10 by operating the drive device 71. Thus, holding and rotating the submerged nozzle can be easily performed.

Further, because the upper surface of the submerged nozzle 10 is in sliding contact with a lower surface 9*a* of a lower nozzle 9 located under the slide valve device 8, the submerged nozzle 10 can be smoothly rotated.

DESCRIPTION OF EMBODIMENTS

Figure 1:
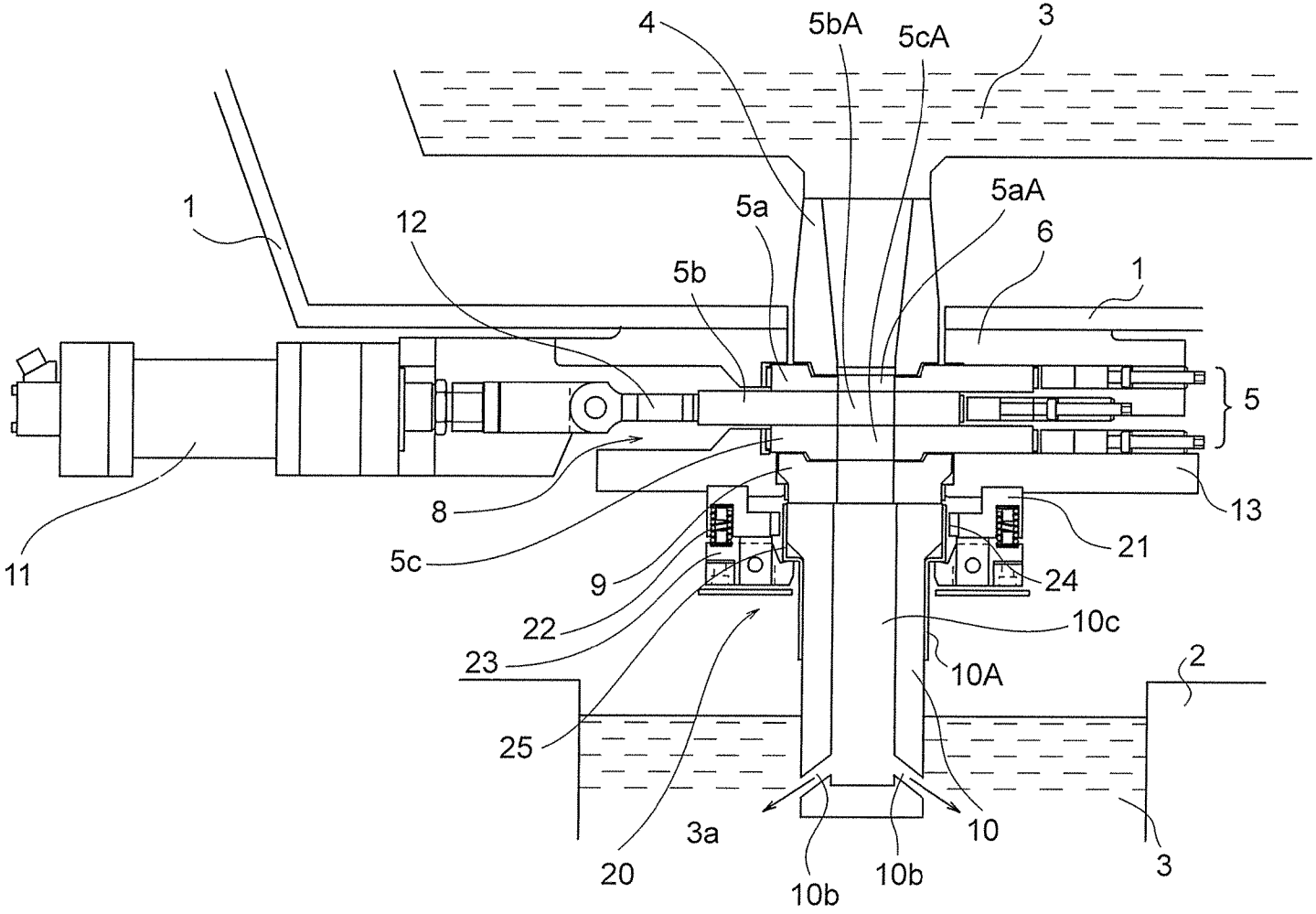
FIG. 1 is a schematic view showing a molten-metal flow path from a tundish 1 to a water-cooled mold 2 in an apparatus in which a general continuous casting apparatus for steel-slab is provided with a submerged-nozzle quick replacement mechanism.

This invention provides a slab continuous casting apparatus which is designed to improve the quality of ingots produced by changing the discharge angles of the molten metal arbitrarily during casting, rotating and stirring the molten metal in the slab mold and solidifying the molten metal.

EXAMPLES

Hereinbelow, preferred embodiments of the slab continuous casting apparatus according to the invention are described with reference to the accompanying drawings.

Before explaining the slab continuous casting apparatus according to the invention, the history that the present inventors have developed the present invention is described. That is, the present inventors studied a method for obtaining a rotational flow of molten metal by discharge flows from the submerged nozzle in a slab continuous casting apparatus by way of water model experiments with consulting Patent Document 2 and Patent Document 7. The sizes of the water model experiments were equivalent to those of actual machines, with a slab thickness of 250 mm and a slab width of 2000 mm.

As a result, the followings were found:

(1) The two-hole nozzle such as Patent Document 7 is superior to the nozzle including four discharge holes such as Patent Document 2;

(2) In case of using a two-hole nozzle, it is preferable to let discharge flows strike against the longer-side wall. It is not so preferable to direct the discharge flows toward the shorter-side wall as Patent Document 7; and (3) The discharge direction is preferably directed toward a range of 15% to 40% of the longer-side length which extends from the intersection point between the shorter side and the longer side of the mold toward the central portion of the longer side. In other words, 45° or more of the discharge angle as Patent Document 2 is not preferable and making the discharge direction excessively close to the diagonal-line direction is not also preferable.

Based on the above knowledges, the present inventors studied applying to the actual machines.

With respect to (2) above, Patent Document 7 cites Patent Document 2 to be concerned about causing delay of solidification or redissolution of solidified shells due to striking of discharge flows against the longer side or occurring breakouts in remarkable cases. However, studying Patent Document 2 in detail, the length-to-width ratio of the square mold used for the studying is about 2:3 and the angles formed by the discharge direction and the individual sides are about 60° and 75°. Further, Patent Document 1 on which Patent Document 2 is based specifies that the angle is (45±10)°. On the other hand, in case of applying the techniques corresponding to the knowledges, even if the discharge flows strike against the longer side, the angle of the discharge direction results in one close to a parallel flow unlike Patent Document 2. Thus, the present inventors thought that there is no problem.

Based on such a study, after attempting applications to the actual machines, successful rotational flows were obtained. However, a problem occurred that sufficient rotational flows cannot be obtained from the middle of casting although sufficient rotational flows were obtained in the initial stage of casting. Studying the causes of the problem, there were two causes and one of them was the effect of the drift flows that occur in the submerged nozzle due to the opening degree of the slide valve located at the upper portion of the submerged nozzle. The slide valve normally regulates the flow rate by moving in a direction of the longer side. As a result, because the molten metal flow which has passed through the slide valve tends to be biased in the submerged nozzle and the discharge direction is inclined relative to one side of discharge holes, the angle of the discharge flow subtly changes depending on the opening degree of the slide valve. For this reason, sufficient rotational flows could not be obtained. The other cause was the effect of the inclusions adhered to the inside of the nozzle. Generally, the inclusions in the molten metal may be deposited around the discharge holes of the submerged nozzle after a short time from the beginning of casting and the discharge flow of the molten metal may change. In particular, by the inclusions deposited on one side of the discharge holes, the directions of the discharge flows changed in the middle of casting and sufficient rotational flows were not obtained.

Even in such a case, a sufficient stirring effect is required for the molten metal within the mold. Under these conditions, the present inventors thought that an apparatus capable of changing the discharge direction during the course of casting and moreover allowing submerged nozzles to be replaced is indispensable and thus reached the present invention.

FIG. 1 shows a schematic view of a molten-metal flow path from a tundish 1 to a water-cooled mold 2 in a general steel-slab continuous casting apparatus equipped with a submerged-nozzle quick replacement device.

Molten metal 3 stored in the tundish 1 is supplied through an upper nozzle 4 to a slide valve 5 comprising an upper plate 5*a*, a slide plate 5*b* and a lower plate 5*c*. This slide valve 5 comprises two or three perforated plate bricks 5*a*, 5*b*, 5*c*, and the size of the overlapping perforations 5*a*A, 5*b*A, 5*c*A are adjusted by sliding one of the plate bricks 5*a*, 5*b*, 5*c* to control the flow quantity of the molten metal 3 passing through the perforations 5*a*A, 5*b*A, 5*c*A. The molten metal 3 that has passed through the slide valve 5 is supplied to a submerged nozzle 10 via a lower nozzle 9 supported by a seal casing 13. However, there are some cases where the molten metal 3 is supplied directly from the slide valve 5 to the submerged nozzle 10 without using the lower nozzle 9. The molten metal 3 discharged from discharge holes 10*b* of the submerged nozzle 10 is solidified in the water-cooled mold 2.

In addition, the slide valve 5 is fitted to a slide valve device 8. The slide valve device 8 comprises a housing 6, a slide case 12, a seal case 13, and a hydraulic cylinder 11 for slide. The two or three perforated plate bricks 5*a*, 5*b*, 5*c* are fixed to the housing 6, the slide case 12, and the seal case 13, respectively. One of the two or three plate bricks 5*a*, 5*b*, 5*c* is constructed so as to be slidable by the hydraulic cylinder 11 for slide fixed on the housing 6 side.

A submerged-nozzle quick replacement mechanism 20 is constructed so as to hold and upwardly press the submerged nozzle, attached below the slide valve device 8, and constructed so as to allow the submerged nozzle to be easily replaced when the dissolved loss of the submerged nozzle becomes heavy during sequential continuous castings.

Figure 2:
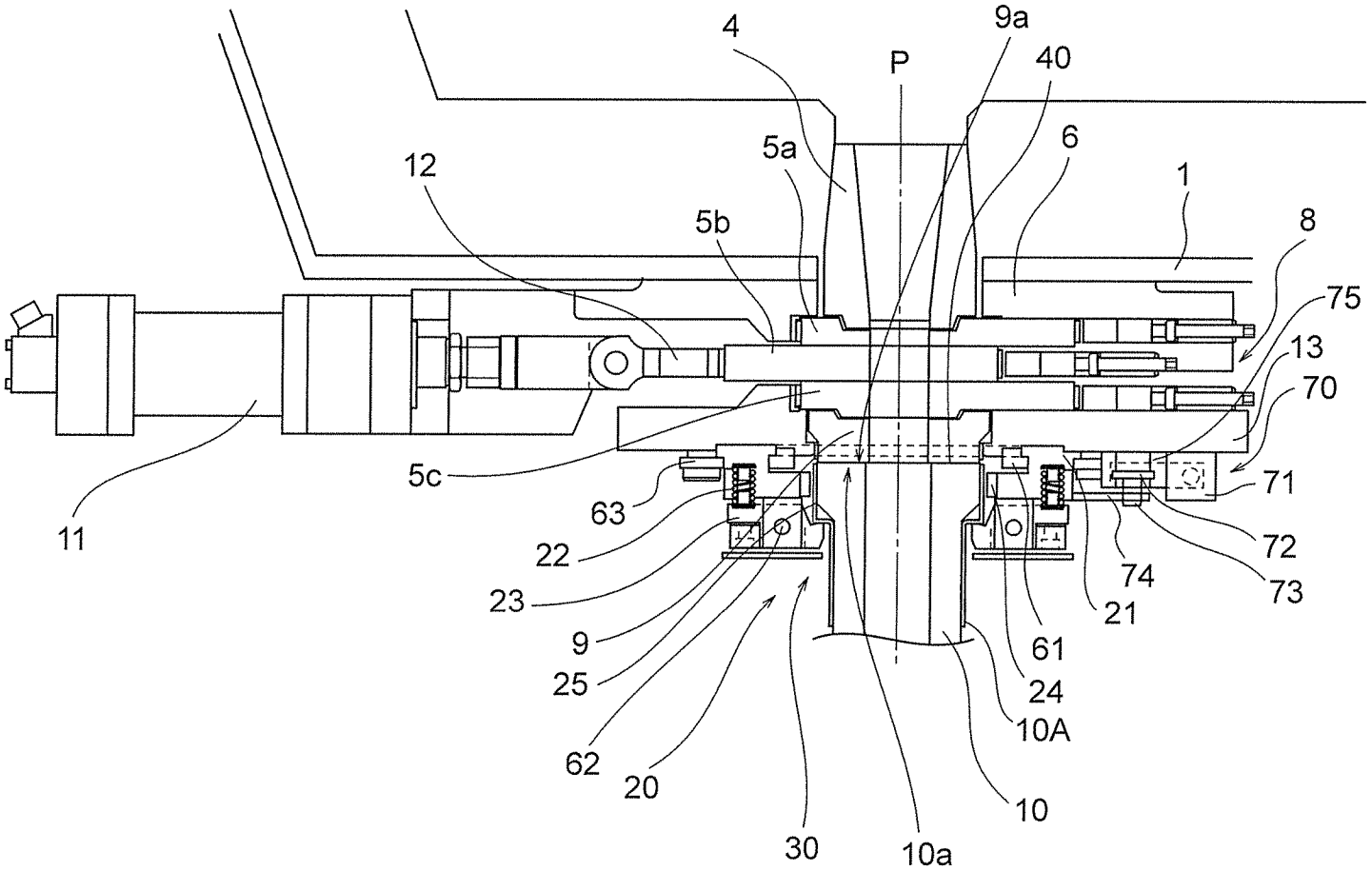
FIG. 2 is a front view showing a slab continuous casting apparatus in which a discharge-direction changing mechanism is provided between a lower nozzle and a submerged nozzle according to the invention.

Next, the construction of the invention as well as its basic operation are described with reference to FIG. 2.

This invention is characterized in that a discharge-direction changing mechanism 30 capable of arbitrarily changing the discharge angle of the molten metal 3 in a horizontal cross section during casting is provided between the slide valve device 8 and the submerged nozzle 10. Enabling the angle to be changed during casting provides an effect of ensuring the necessary discharge direction for obtaining a rotational flow and makes it possible to continuously obtain a successful rotational flow. In particular, the need for changing the discharge direction of the molten metal 3 mainly arises in three cases as described below.

The first case is that the inclusions are deposited around the discharge holes 10*b* during casting so that the discharge directions from the discharge holes 10*b* are changed during casting. Such changes in the discharge directions are detected from the observation of the molten metal surface in the mold, changes in the molten metal level, changes in the temperature measured by the thermometer provided in the water-cooled mold 2, and the like. If any of such changes is occurred, changing the directions of the discharge holes 10*b* to proper angles may correct the discharge directions to maintain proper discharge directions.

Although the flow of the molten metal 3 in the mold 2 cannot be directly observed, the flow of the molten metal 3 in the mold 2 can be inferred by observing the surface of the molten metal 3 (or the surfaces of the mold powders because they are usually present) in the mold 2. For example, the flow can be estimated by the variation of the surface height of the molten metal 3 or the way of the surface flow (state of rotation). By checking them visually, the fitting angle of the submerged nozzle 10 is adjusted so as to obtain the optimum discharge direction.

Also, the variation of the surface height of the molten metal 3 can be detected by a noncontact type displacement sensor (not shown) such as an ultrasonic displacement sensor or an infrared displacement sensor. Moreover, the water-cooled mold 2 is provided with a thermometer (not shown) (e.g., thermocouple, etc.) for sensing breakouts, and a current discharge direction can also be known by its temperature change. The discharge angle may also be changed based on those information, and further automatic control is also adoptable.

The second case is that the width or thickness of the water-cooled mold 2 is changed during casting. As the width or thickness of the water-cooled mold 2 is changed, the proper discharge direction to obtain a rotational flow is also changed. By enabling the angle to be changed during casting, it also becomes possible to ensure the proper discharge direction even when the width or thickness of the water-cooled mold 2 is changed.

The third case is that the discharge direction is changed between an unsteady casting state and a steady casting state. For example, in the initial stage of casting, a rotational flow is not generated in the water-cooled mold 2. In case of generating a rotational flow in the state, it is possible to reach the steady state early by setting the angle for facilitating to generate a rotational flow. Meanwhile, once a rotational flow is generated in the mold, the rotational flow is also maintained by the inertia force of the molten metal. In this case, the angle should be adjusted such that breakouts are less likely to occur. Further, the casting speed is slowed down upon replacing the ladle during continuous casting, changing the steel type during sequential continuous castings of different steels or the like. Because the casting state is also unsteady in this conjuncture, changing the discharge direction by the above-described method can also reach the steady state more early. As a concrete method for adjusting the angle, for example, gradually decreasing the angle formed by the longer side and the discharge direction after making the angle large in the unsteady state of the initial stage of casting or the like can be adopted.

Although the discharge angle is changed in the above-described cases, the discharge angle may be changed in the middle of casting as required without limiting to such cases.

A slab continuous casting apparatus according to the invention is described below by using FIGS. 2 to 11. However, the drawings are illustrative views and the invention is not limited to these. Further, the submerged-nozzle quick replacement mechanism can adopt a general mechanism and is not limited to the device described herein.

The discharge-direction changing mechanism 30 is constructed with a sliding-contact surface 40 provided at an upper surface 10*a* of the submerged nozzle 10 which can be changed in discharge direction, a submerged-nozzle quick replacement mechanism 20, and a drive mechanism 70 for changing the discharge direction of the molten metal 3 from the submerged nozzle 10.

A position where the discharge-direction changing mechanism 30 is provided is preferably between the slide valve device 8 and the submerged nozzle 10.

Upon replacing the submerged nozzle, the submerged-nozzle quick replacement device normally pushes a used submerged nozzle 10*e* with an unused submerged nozzle 10*n* to move the unused submerged nozzle 10*n* along one axis to a casting position and moves the used submerged nozzle 10*e* to a removal position. Therefore, the flange portion of the submerged nozzle is generally made axisymmetrically instead of point symmetrically, for example, in a rectangular shape to move the submerged nozzle along one side line of the rectangular shape for replacement.

In contrast, since the discharge-hole directions are changed during casting in the apparatus of the invention, the flange portion of the submerged nozzle is also rotated about a center axis of the submerged nozzle accordingly. However, the nozzle replacement cannot be performed unless one side line of the flange portion is parallel to the replacement direction of the submerged nozzle.

Therefore, it is simple to rotate the submerged nozzle together with the submerged-nozzle quick replacement mechanism and return the submerged nozzle to the replacement position upon replacing the submerged nozzle.

In case of providing the lower nozzle 9 between the slide valve 5 and the submerged nozzle 10 as described above, the sliding-contact surface 40 is preferably provided between the lower nozzle 9 and the submerged nozzle 10. Further, without the lower nozzle 9, the sliding-contact surface 40 may be provided between the slide valve 5 and the submerged nozzle 10. FIGS. 2, 4, 5 and 7 show the case in which the lower nozzle 9 is provided between the slide valve 5 and the submerged nozzle 10.

In addition, as is well known, a metallic submerged nozzle case 10A is provided on the upper outer periphery of the submerged nozzle 10.

Next, the sliding-contact surface 40 which is used so as to be able to change the discharge direction in the submerged nozzle 10 is constructed with the upper surface 10*a* of the submerged nozzle 10 and a lower surface 9*a* of the lower nozzle 9. Without using the lower nozzle, the sliding-contact surface 40 is constructed with the upper surface 10*a* of the submerged nozzle 10 and a lower surface 5*c*B of the lower plate. When the discharge direction of the molten metal 3 is changed, the submerged nozzle 10 is changed in angle so as to pivot leftward and rightward about a center axis P of the submerged nozzle 10 and thus rotationally slides in contact with the sliding-contact surface 40. Such sliding-contact surface 40 makes it possible to change the discharge direction while airtightness is maintained. If such airtightness is not maintained, the problem occurs that when the molten metal 3 flows from the lower nozzle 9 toward the submerged nozzle 10, the pressure decreases in vicinities of the flow according to Bernoulli's principle, a large amount of air is sucked into the molten metal 3, the molten metal 3 is oxidized and a large amount of air bubbles is captured in the cooled strands, which is not preferable. Further, if such airtightness is not maintained, in case of using the carbon-containing refractory material, the refractory material in which carbon is oxidized by air suction may be damaged and reach to steel leaks in a remarkable case, which is not preferable.

Because the frequency of changing the directions of the discharge holes 10*b* is not so high, the sliding-contact surface 40 is not remarkably worn. Therefore, although the refractory material forming the sliding-contact surface 40 is not particularly limited, the refractory material containing carbon is more preferable because carbon also functions as a solid lubricant.

The sliding-contact surface can be coincident with the upper surfaces of the unused and used submerged nozzles in the submerged-nozzle quick replacement mechanism 20.

Figure 7:
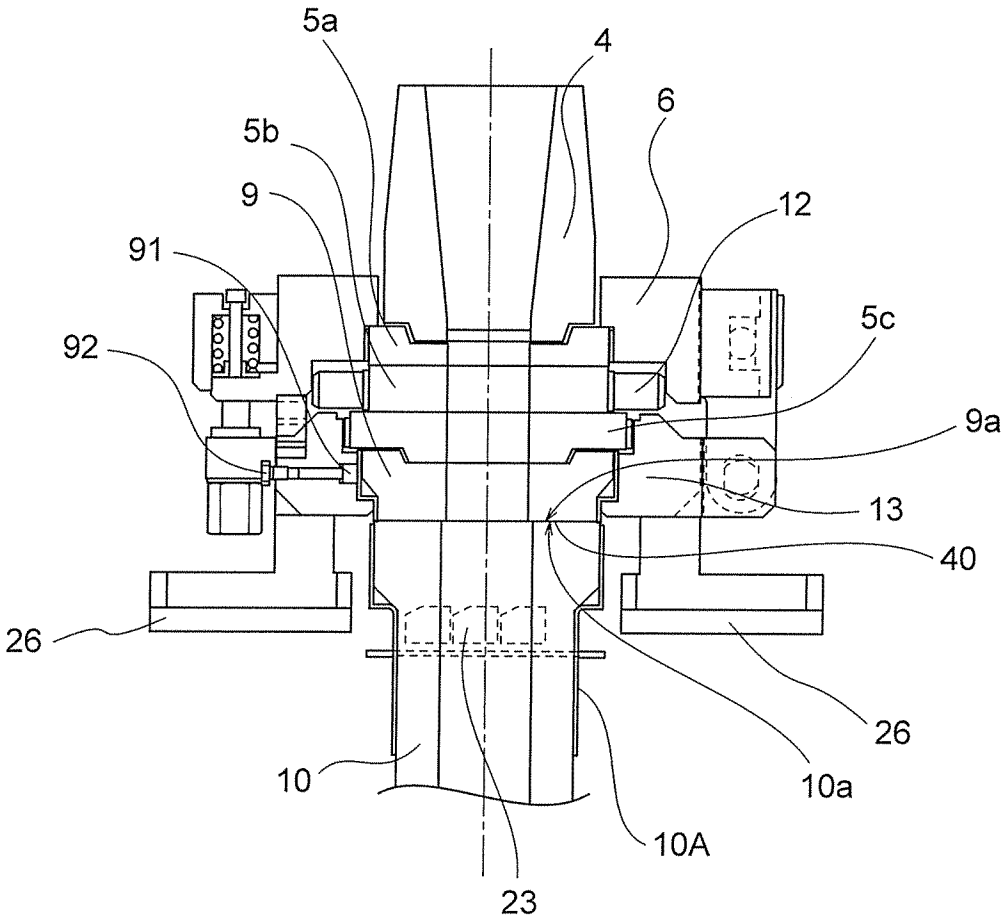
FIG. 7 is a sectional view showing a structure for preventing corotation of the lower nozzle according to the invention.

The lower nozzle 9 is prevented from rotating by an attachment 91 in which a locking bolt 92 is tightened as shown in FIG. 7 so as not to rotate simultaneously with change in the directions of the discharge holes 10*b* of the submerged nozzle. Also, the lower nozzle 9 may be machined such as chamfering. Further, the rotation may be prevented by a square shape instead of a circular shape.

Next, the submerged-nozzle quick replacement mechanism 20 is described.

The submerged-nozzle quick replacement mechanism 20 comprises bases 21, clampers 23 supported by clamper pins 62 provided in the bases 21, and springs 22 provided on the bases 21 to bias the dampers 23 upward.

Figure 5:
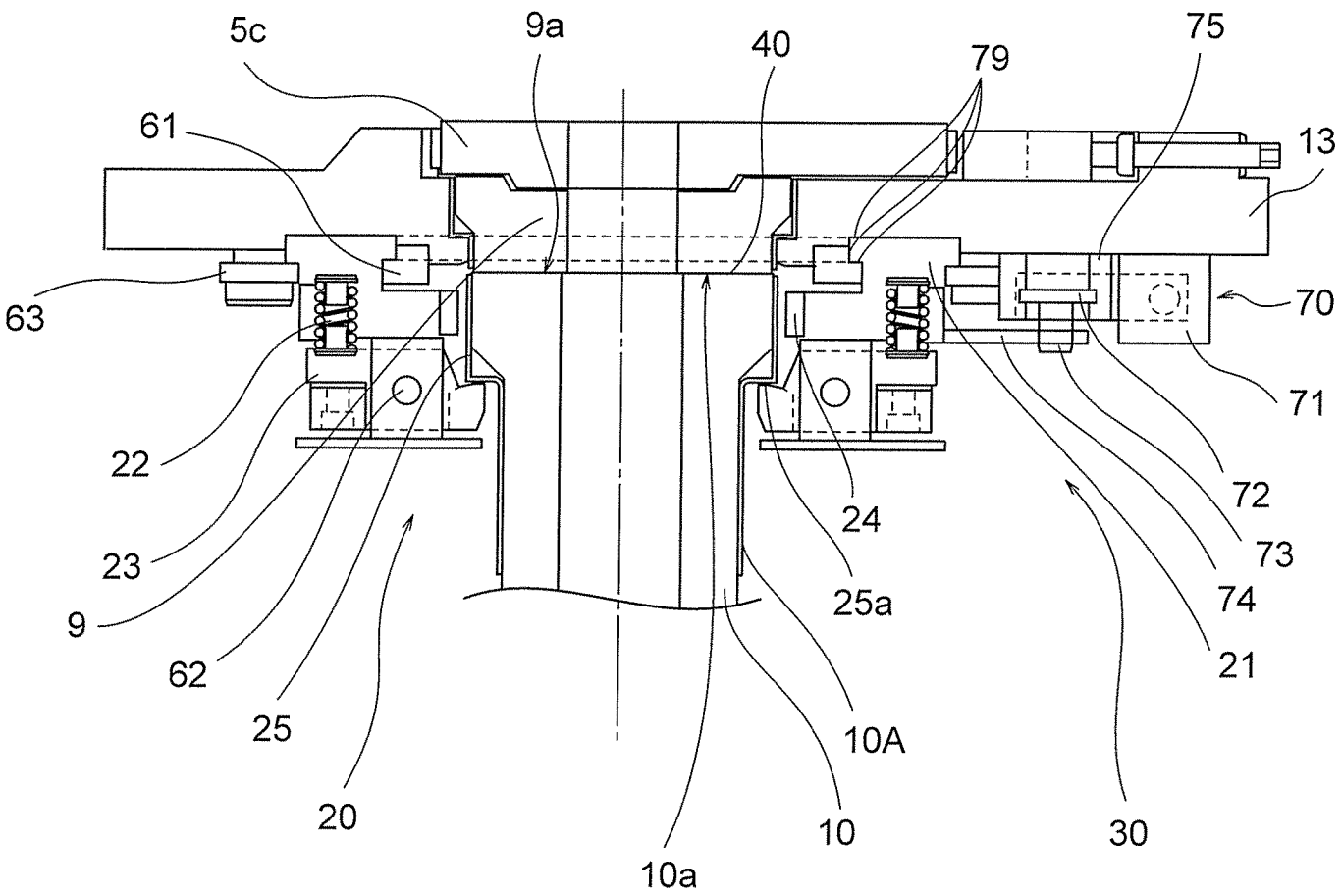
FIG. 5 is an enlarged view of the discharge-direction changing mechanism according to the invention of FIG. 2.

A dampers 23 and a springs 22 are a binary mechanism opposed to each other so as to form an angle of 180° and the bases 21 on the left and right are coupled by a coupling bars 78. The submerged nozzle 10 inserted along guide rails 26 is supported at a flange lower surface 25*a* by a plurality of dampers 23, and the dampers 23 press the submerged nozzle 10 upward by force of the springs 22 using the principle of leverage as a fulcrum consisting of each clamper pin 62. This motion causes the sliding-contact surface 40 to be pushed vertically upward with moderate force so that the airtightness against the sliding-contact surface 40 is maintained. FIG. 5 shows an enlarged view of the submerged-nozzle quick replacement mechanism shown in FIG. 2. Although the type of the spring 22 is not limited and given as a coil spring in the figure, a coned disc spring, a plate spring or the like may be used.

The magnitude of the pressing force is preferably 100 to 2000 Pa as a contact pressure. If the pressing force is less than 100 Pa, the airtightness cannot be sufficiently maintained and the risk of steel leaks increases, which is not preferable. If the pressing force is greater than 2000 Pa, the resistance at the sliding-contact surface is too large to change the angle, which is not preferable. Meanwhile, it is also possible to press strongly in a normal time, press weakly upon changing the angle and then fixedly press strongly again.

Further, in the submerged-nozzle quick replacement mechanism 20, the base 21 is held by a support guide 61 and support guide rollers 63 held by the seal case 13, the dampers 23 are held by the clamper pins 62 attached to the base 21, and the submerged nozzle 10 is held by the dampers 23 (FIG. 5).

The outer periphery of the base 21 is formed into a circular shape around the center axis P of the nozzle with a key-shaped cross section. The support guide 61 for supporting the base 21 is also formed into a circular shape around the center axis P of the nozzle with a key-shaped cross section, and the support guide rollers 63 also each have a key-shaped cross section. The support guide 61 is held by the seal case 13. The base 21 and the support guide 61 are constructed by the rotating surfaces, respectively, so as to be put into sliding contact with each other around the center axis P, and attached so as to be rotatably sliding contact with each other. A sliding surface 79 between the support guide 61 and the base 21 form the key-shaped lower surface and side surface of the base 21. The sliding surface 79 is also formed between the seal case 13 and the base 21. A moderate gap is preferably provided between the base 21 and the seal case 13. However, if the gap is too large, it is not preferable because the play of the apparatus is too large. Therefore, it is desirable that the gap is made to be as small as possible in consideration of thermal expansion.

Upon receiving the force for changing the angle as will be described later from a later-described drive device 71, the base 21 contact-slidably held by the seal casing 13 slides in contact toward the rotational direction about the center axis P, so that the submerged nozzle held via the clampers 23 is rotated, thus allowing the discharge directions of the discharge holes 10*b* to be changed. A proper lubricant may be applied to the sliding surface 79 between the seal casing 13 and the base 21. Moreover, a bearing or the like may be placed at this surface.

Next, the drive mechanism 70 for changing the discharge-direction is described. The drive mechanism 70 for changing the discharge-direction to drive the discharge-direction changing mechanism 30 for the molten metal 3 of the submerged nozzle 10 comprises a drive device 71 for applying the force for changing the angle and a transmission part 90 for transmitting the force from the drive device 71 to the submerged-nozzle quick replacement mechanism 20 by which the submerged nozzle 10 is held.

Figure 8:
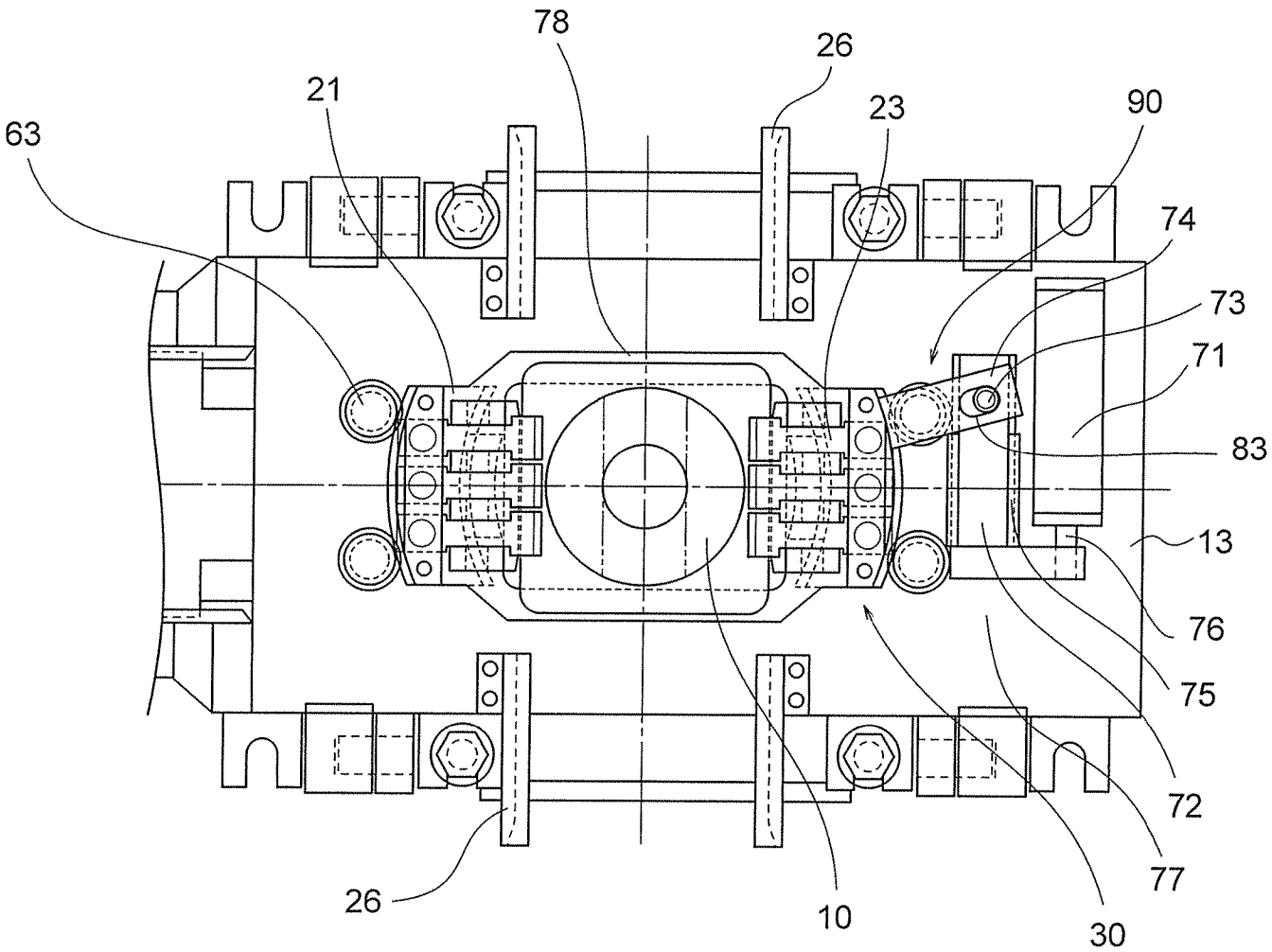
FIG. 8 shows an example of the structure of the drive device for the discharge-direction changing mechanism of the submerged nozzle according to the invention.

First, the transmission part 90 is described. The transmission part 90 comprises a lever 74 and a pin 73 (FIG. 8).

The lever 74 is fixed to the base 21. The size (width and length) of the lever 74 is not particularly limited. By applying a horizontal force or a rotating directional force about the center axis P of the submerged nozzle 10 to the tip of the lever 74 via the pin 73, the base 21 is rotated about the center axis P so as to change the angle while the submerged nozzle 10 held by the submerged-nozzle quick replacement mechanism 20 also changes the angle simultaneously, thus making it possible to change the discharge direction.

Figure 6:
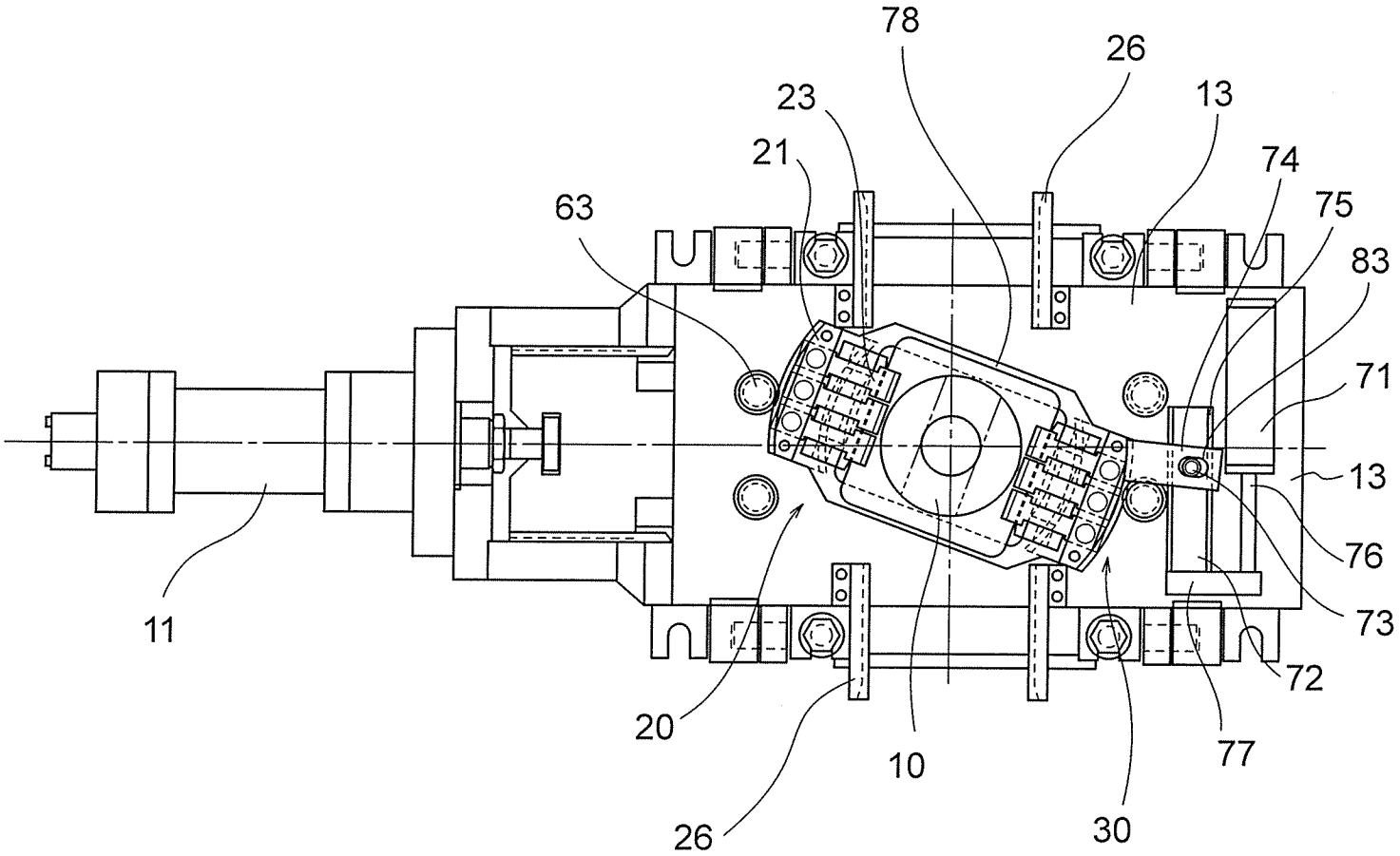
FIG. 6 is an exemplary view showing a rotating position in which the discharge angle has been changed in the discharge-direction changing mechanism according to the invention of FIG. 2.

By applying the force from the drive device 71 to the tip of the lever 74, the discharge direction can be changed (FIG. 6).

Figure 9:
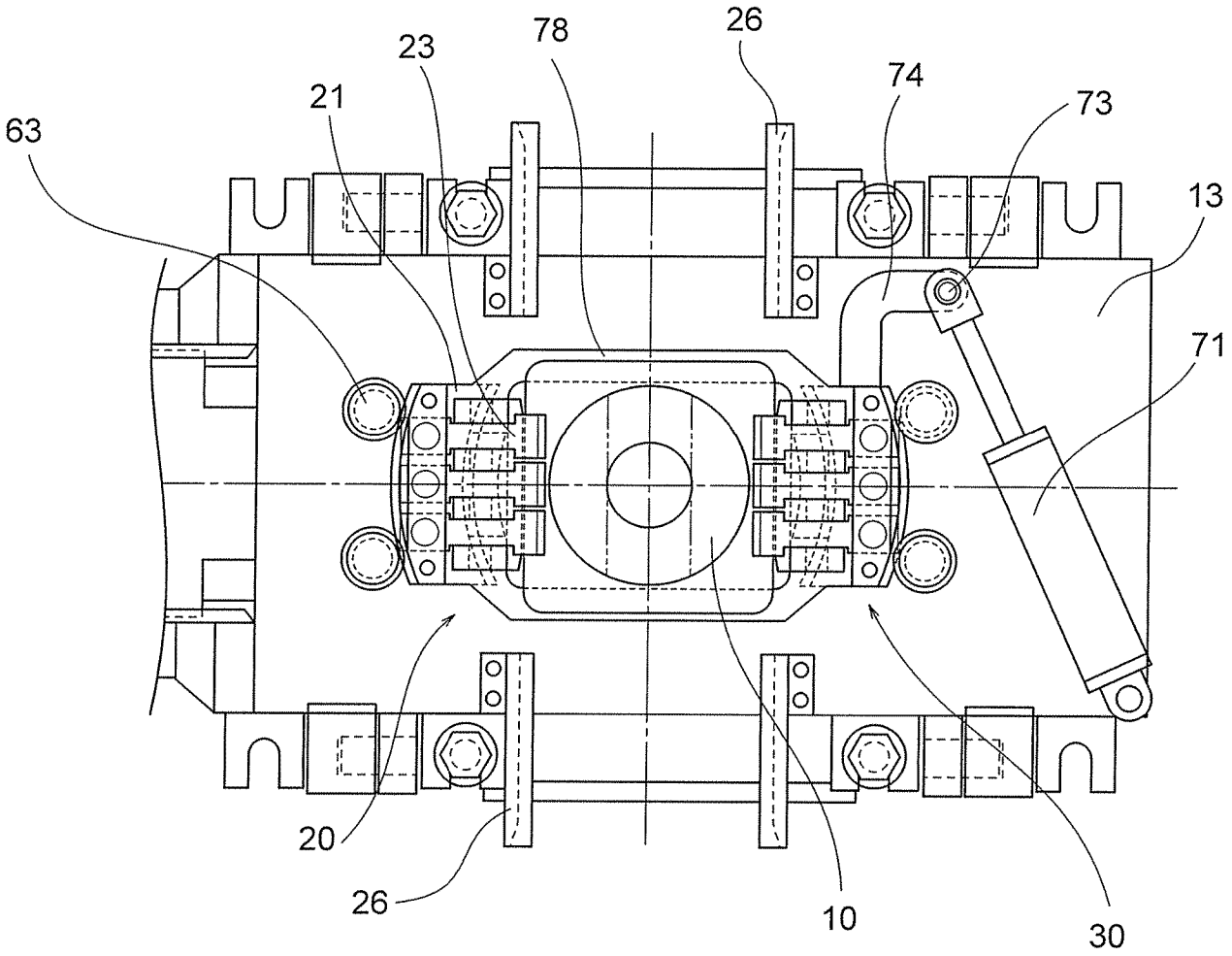
FIG. 9 shows another example of the structure of the drive device for the discharge-direction changing mechanism of the submerged nozzle according to the invention.

As this drive device 71, for example, a hydraulic cylinder may be used. The hydraulic cylinder is fixed to the seal case 13, and a slider 72 is attached to the tip of a rod 76 by a coupling member 77, where the tip of the rod 76 and the slider 72 slide simultaneously. The slider 72 is supported on the seal case 13 by a guide 75. Since the slider 72 is provided with the pin 73 so as to be coupled to a pin hole 83 of the lever 74 fixed to the base 21, the discharge angle can be changed by driving the drive device 71. Although the pin hole 83 is elliptical-shaped in the drawings, it is not limited to this. This coupling method is not limited to the structure of the embodiment and may be any coupling method where the motion of the drive device 71 is transmitted to the rotational motion of the submerged nozzle 10. The example of this is shown in FIG. 9.

Figure 10:
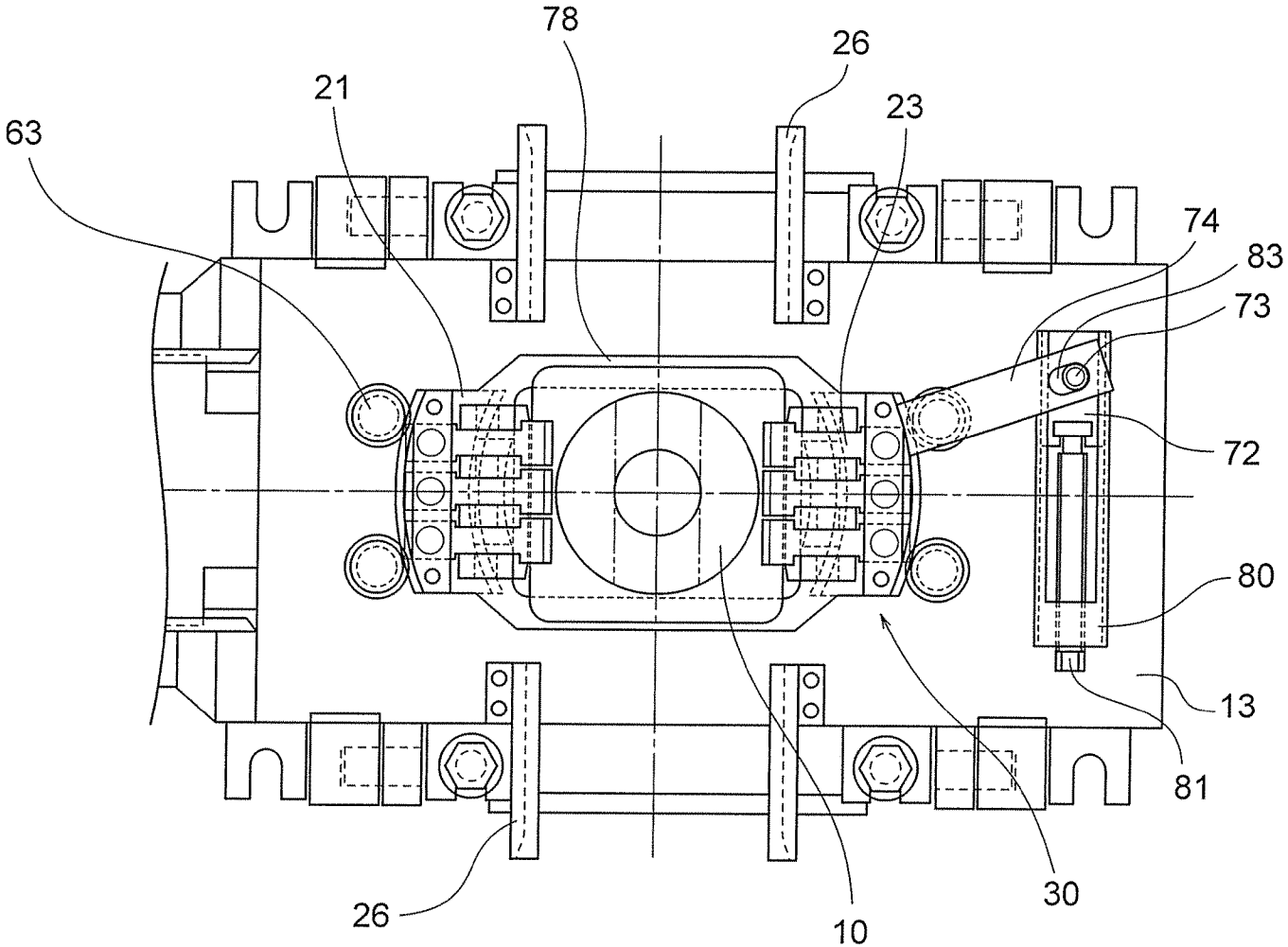
FIG. 10 shows another example of the structure of the drive device for the discharge-direction changing mechanism of the submerged nozzle according to the invention.

The drive device 71 is not limited to a hydraulic cylinder but the slider 72 may be slid via a female screw block 80 by rotating a screw rod 81 of FIG. 10. In this case, a rotating motor, a decelerator or the like is used as the drive device 71 instead of a hydraulic cylinder.

Figure 11:
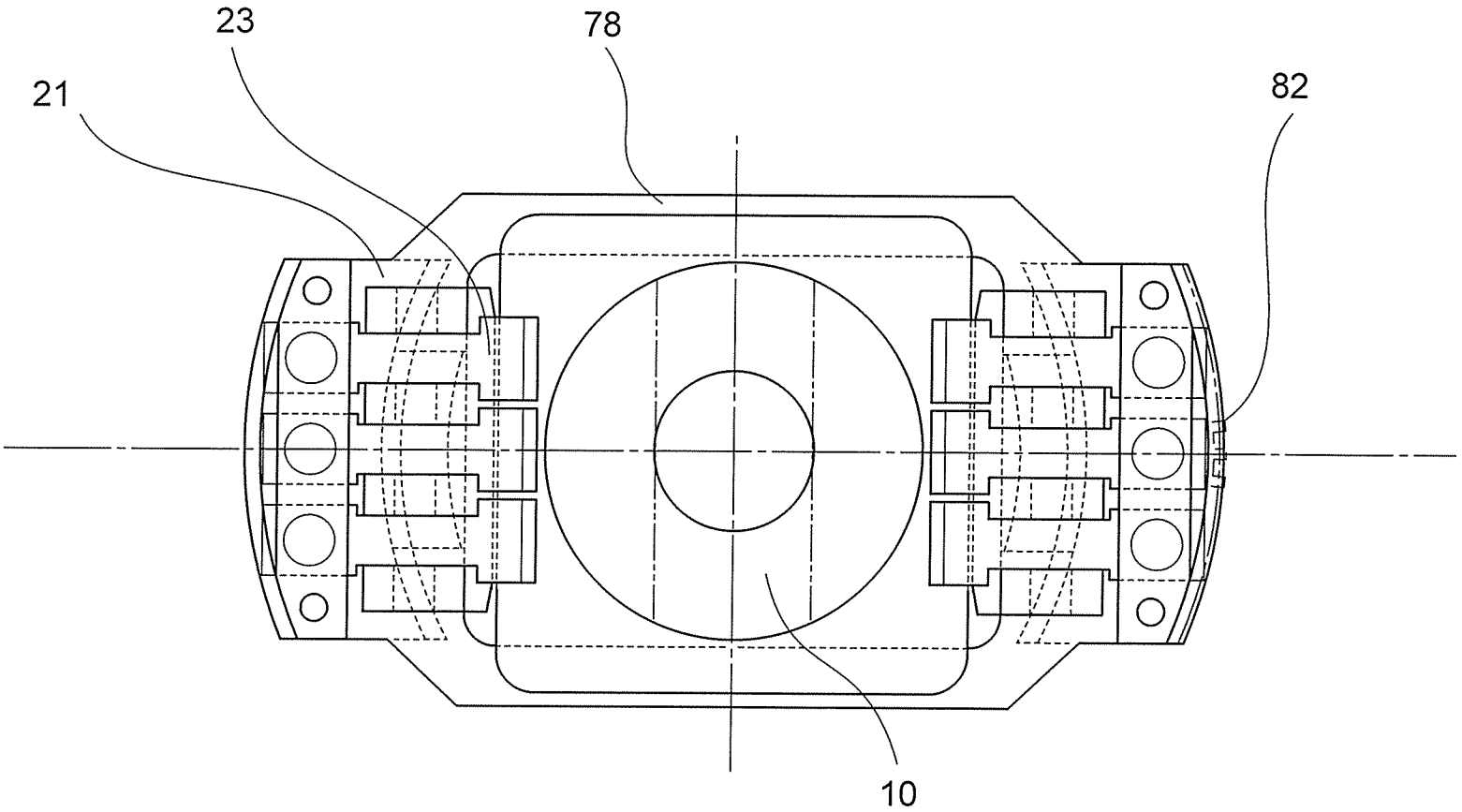
FIG. 11 shows another example of the structure of the drive device for the discharge-direction changing mechanism of the submerged nozzle according to the invention.

Also, a circular-shaped gear 82 may be provided in a part of the outer periphery of the base 21 instead of the lever 74 to use a worm gear, a belt, a decelerator, a motor or the like for the drive device 71 (FIG. 11; worm gear, belt, decelerator and motor are not shown).

Preferably, a variable angle for the discharge is at least 30° or more. If adjusted to the optimum position, the change in angle during the operation may be set to about ±10°. However, in view of various ways of use, the change in angle may be set to about 60°.

FIG. 6 shows an example of the invention in which the discharge angle has been changed.

Next, the upper surface 10*a* of the submerged nozzle 10 is provided with the above sliding-contact surface 40.

The submerged nozzle 10 has a molten metal inflow path 10*c* in the upper part thereof and a pair of discharge holes 10*b* opposed to each other in axis symmetry in the lower part thereof, and is configured to discharge a discharge flow 3*a* of the molten metal 3 toward a direction of the shorter-side wall of the water-cooled mold 2. The shapes of the molten metal inflow path 10*c* and the discharge holes 10*b* are not particularly limited, and may be formed into a rectangular, round or other shapes. As to the number of discharge holes, the submerged nozzles having two holes in opposite directions as described above are preferable. Further, a three-hole type submerged nozzle 10 equipped with another discharge hole 10*b* on the lower side of the submerged nozzle 10 in addition to the above two holes may also be used.

Preferably, the molten metal 3 is discharged from the opposed-two-hole type submerged nozzle 10 toward the longer side, where the discharge direction is directed from the intersection point of the shorter-side line and longer-side line of the mold toward the center of the longer-side within a range of 15% to 40% of the length of the longer-side. If the discharge direction is less than 15% of the range, a part of the discharge flow strikes against the short side so that a rotational flow cannot be effectively yielded. If the discharge direction is more than 40% of the range, the flow of the discharge flow 3*a* up to the shorter side along the longer side does not continue after the discharge flow 3*a* strikes against the longer side. Also, in this case, a rotational flow cannot be efficiently yielded. More preferably, the discharge direction is 20% to 35% of the range.

The upper surface 10*a* of the submerged-nozzle upper surface 10*a* contacts the lower-nozzle lower surface 9*a* to form the sliding-contact surface 40. Since the cross-sectional surface of the lower nozzle 9 is generally circular, the sliding-contact surface 40 is also preferably circular. Meanwhile, in the submerged-nozzle quick replacement mechanism 20, a rectangular square flange 25 is attached to the upper surface of the submerged-nozzle. Therefore, it is desirable that the perimeter of the circular sliding surface is protected by an iron case, the submerged nozzle is held at its outer peripheral portion, and the square flange 25 which is coincident with the pressing clampers 23 is attached. With this arrangement, holding and attachment can be carried out smoothly. Moreover, the deformation of the upper part of the submerged nozzle decreases to improving the sealability and to provide strength to the submerged nozzle so that cracks are prevented from being generated in the submerged nozzle. Since the outer-peripheral square flange 25 is separate from the sliding-contact surface 40, there is an advantage that even when the flange portion is deformed, the sealability of the sliding-contact surface 40 is not negatively affected.

As an attachment and removal, or quick replacement, of the submerged nozzle 10, the method described below can be adopted. However, other methods that are similar to the method may also be adopted without problems.

The discharge direction of the submerged nozzle 10 is changed as required during continuous casting. However, if the discharge direction remains having changed, quick replacement of the submerged nozzle may not be carried out. Upon quick replacement of the submerged nozzle, first, its angle is adjusted so that one side of the square flange 25 parallel to the discharge direction of the submerged nozzle 10 becomes parallel to the guide rail 26. If they are not parallel to each other, interference would occur between the square flange 25 and the guide rail 26 of the submerged nozzle 10 during the nozzle replacement to prevent the replacement.

Figure 3:
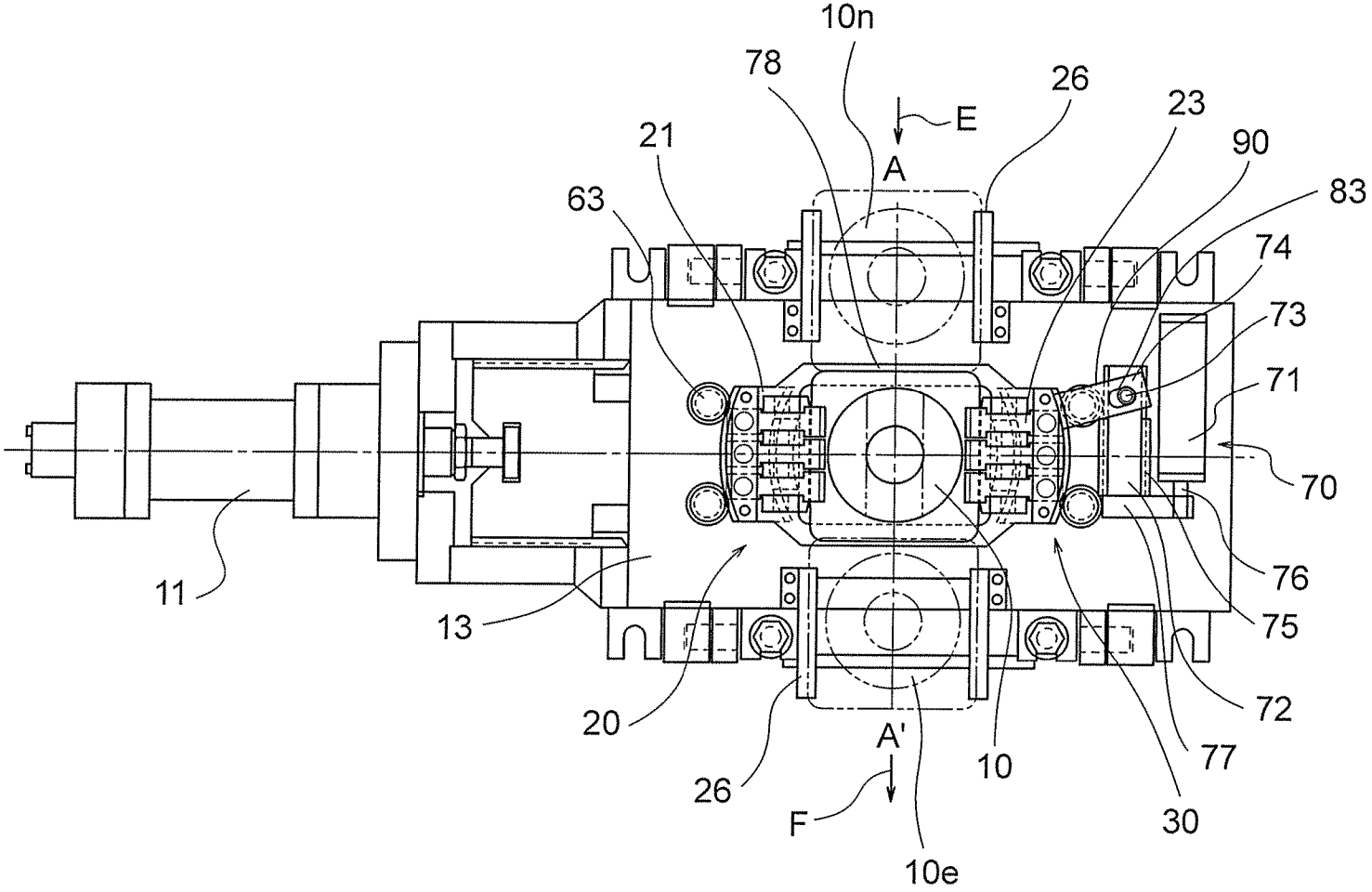
FIG. 3 is a plan view of FIG. 2, in which an unused submerged nozzle and after-use submerged nozzle depicted by two-dot chain lines show the positions for nozzle replacement and there are nothings at these places when the discharge direction is changed.
Figure 4:
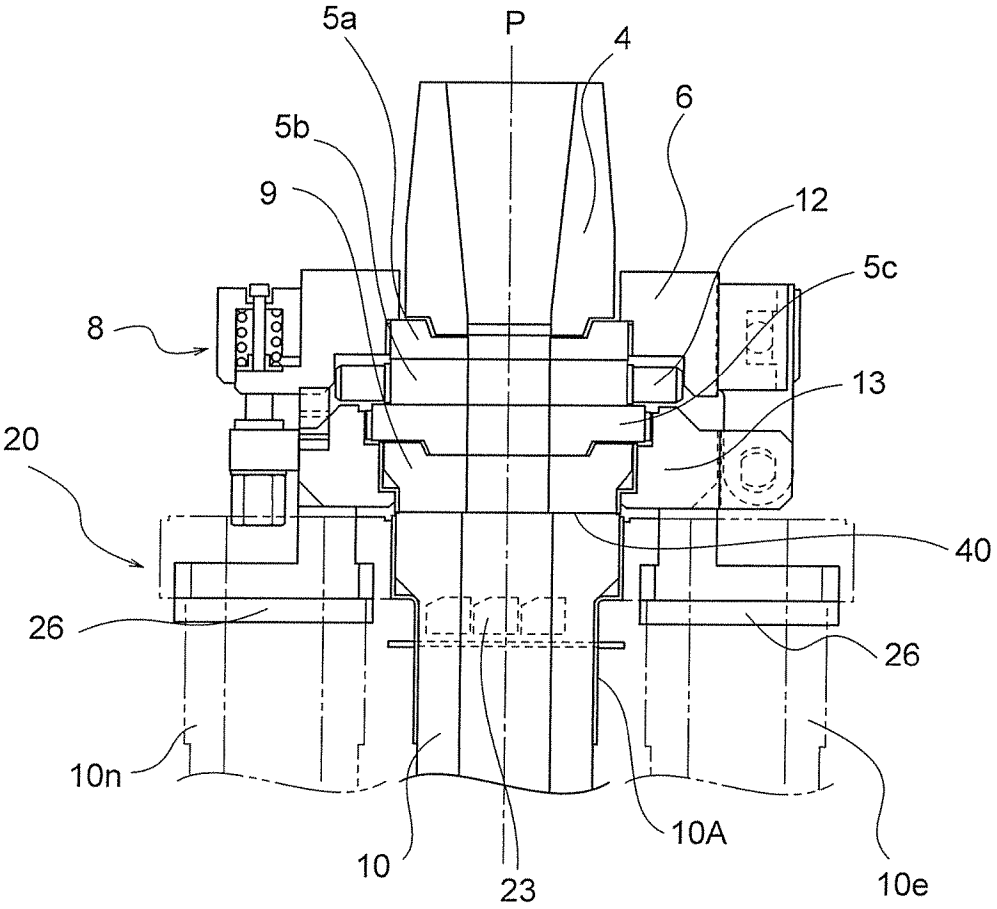
FIG. 4 is a sectional view taken along the line A-A' in FIG. 3.

Then, the unused submerged nozzle 10*n* is set to the position drawn by two-dot chain lines in FIG. 3.

After the opening degree of the slide valve 5 is narrowed to lower the casting speed, the slide valve 5 is completely closed so that injection of the molten steel from the submerged nozzle into the mold is temporarily stopped.

With use of an extrusion device (not shown), the unused submerged nozzle 10*n* is pushed toward the lower portion in FIG. 3 as indicated by arrow E. The submerged nozzle 10 is pushed by the unused submerged nozzle 10*n* so as to be moved to the position for the used submerged nozzle 10*e*. At a point where the center axis of the unused submerged nozzle 10*n* comes to the center position P of the submerged nozzle 10 before being moved, the unused submerged nozzle 10*n* is stopped. By the motion of the clampers 23, the unused submerged nozzle 10*n* is pressed against the lower surface of the lower nozzle 9.

Thereafter, the slide valve 5 is opened and the molten steel begins to be supplied through the unused submerged nozzle 10*n* to resume the continuous casting.

Thereafter, the used submerged nozzle 10*e* is removed out of the interior of the mold as indicated by arrow F.

Next, as to the plate bricks 5*a*, 5*b* and 5*c* to form the above-described slide valve 5 used in the invention, no special plate bricks are required and conventional plate bricks may be used. That is, the material to be used may be alumina-carbon material, alumina-zirconia-carbon material, spinel-carbon material, magnesia-carbon material, or the like. Moreover, carbon-free materials such as alumina, magnesia, zircon and zirconia may be used.

For the lower nozzle 9, conventional materials which are commercially known may be used; for example, refractory of alumina-carbon material may be used. Also, alumina-carbon material, alumina-zirconia-carbon material, spinel-carbon material, magnesia-carbon material, or the like may be used. Moreover, carbon-free materials such as alumina, magnesia, zircon and zirconia may be used.

Their shapes are not particularly limited except for the above-mentioned countermeasure of preventing corotation with the sliding-contact surface 40.

Refractory materials which can be used for the submerged nozzle 10 are not particularly limited, and each of oxides such as $Al_2O_3$, $SiO_2$, MgO, $ZrO_2$, CaO, $TiO_2$ and $Cr_2O_3$ may be individually used, while refractory materials combining the oxide and carbon such as scaly graphite, artificial graphite and carbon black may also be used. As a starting material, one of the oxides, for example, alumina, zirconia or the like, may be used, and the material including two or more of the oxides, for example, mullite comprising $Al_2O_3$ and $SiO_2$, spinel comprising $Al_2O_3$ and MgO, or the like may be used. These materials may be adjusted and blended so as to satisfy the characteristics of the individual parts of the submerged nozzle to produce the refractory material. Further, in some cases, carbides such as SiC, TiC and $Cr_2O_3$ or oxides such as ZrB and TiB may be added for the purpose of preventing oxidation or controlling sintering.

There are known techniques aimed at preventing the inclusions in the molten metal from depositing around the discharge holes of the submerged nozzle, which are one providing steps in the inner tube of the submerged nozzle 10 to prevent the drift flows of the molten metal 3 from the interior of the submerged nozzle 10 to the discharge holes 10*b* and one suppressing the change in the discharge flow 3*a* of the molten metal 3 due to the deposited materials by providing a plurality of protruding portions along with one preventing the drift flows of the molten metal 3 from the interior of the submerged nozzle 10 to the discharge holes 10*b*, which is the cause of the deposition around the discharge holes of the submerged nozzle. These may be used in combination with the invention.

Next, continuous casting of the molten metal 3 was carried out by a method according to the invention and a conventional method to fabricate strands. The mold used in each case had the longer-side wall of 1900 mm and the shorter-side wall of 230 mm and its cross section was rectangular. As a submerged nozzle, a nozzle having two axisymmetric holes was used. As the molten metal 3, a carbon steel having 200 ppm of C, 25 ppm of S and 15 ppm of P was chosen and a casting speed was 1.8 m/min in each case.

As to a rotational flow in the water-cooled mold 2, the surface of the mold 2 was observed, and the cases in which a rotational flow occurred and a stable rotational flow continued during sequential continuous castings were evaluated as ◎, the cases in which a rotational flow occurred but a rotational flow became unstable in the middle of sequential continuous castings were evaluated as ○, the cases in which a rotational flow occurred insufficiently were evaluated as Δ, and the cases in which no rotational flow occurred were evaluated as x.

A breakout occurrence index was evaluated depending on the count of breakout alarms issued by a breakout detector installed on the mold 2 and made to be a value which is proportional to the alarm counts with making the value of comparative example 7 being 1.0.

Also, a surface defect occurrence index was made to be a value which is proportional to the number of the surface defects determined from repair status of the strands with making the value of the second charge of comparative example 7 being 1.0. In the first charge of sequential continuous castings, troubles or defects upon the beginning of casting were likely to occur, and there were cases in which defects occurred due to the accidents in the method of the invention and the conventional method. Therefore, the surface defect occurrence index was evaluated by the second charge, which clarifies the difference therebetween. Also, in order to check the effect of nozzle clogging or the like, the surface defect occurrence index was evaluated even with strands of the fifth charge of the sequential continuous castings. In this case, the index was also a value making the second charge of comparative example 7 being 1.0.

TABLE 1

| | | 230 mm of slab thickness 1900 mm of slab width | | | | | | | | | |
|---|---|---|---|---|---|---|---|---|---|---|---|
| | | Example 1 | Example 2 | Example 3 | Comparative Example 1 | Comparative Example 2 | Comparative Example 3 | Comparative Example 4 | Comparative Example 5 | Comparative Example 6 | Comparative Example 7 |
| Discharge direction | Intersection point between the discharge direction and the mold | longer side | longer side | longer side | longer side | longer side | longer side | longer side | longer side | shorter side | shorter side |
| | Distance from the mold intersection point (Ratio of the distance to the length of the longer side) | 35% | 30% | 20% | 45% | 35% | 30% | 20% | 10% | | |
| | Intersection point at the shorter side | | | | | | | | | center between the center of the shorter side and the intersection point | center of the shorter side |
| Whether the discahrge direction is variable or fixed | Variable<br>Fixed | variable | variable | variable | fixed | fixed | fixed | fixed | fixed | fixed | fixed |
| Rotational flow | | ◎ | ◎ | ◎ | × | Δ | ○ | ○ | Δ | Δ | × |
| Breakout occurrence index | | 0.8 | 0.8 | 0.8 | 1.3 | 0.9 | 0.8 | 0.8 | 0.8 | 0.8 | 1 |
| Surface defect occurrence index | Second charge of sequential castings | 0.31 | 0.25 | 0.3 | 0.72 | 0.34 | 0.28 | 0.28 | 0.61 | 0.870.88 | 1.01.0 |
| | Fifth charge of sequential castings | 0.32 | 0.27 | 0.31 | 0.96 | 0.72 | 0.66 | 0.64 | 0.86 | 0.99 | 1.3 |

TABLE 1-continued

| | 230 mm of slab thickness 1900 mm of slab width | | | | | | | | | |
|---|---|---|---|---|---|---|---|---|---|---|
| | Example 1 | Example 2 | Example 3 | Comparative Example 1 | Comparative Example 2 | Comparative Example 3 | Comparative Example 4 | Comparative Example 5 | Comparative Example 6 | Comparative Example 7 |
| Remarks | | | | pursuant to Patent Document 1 | | | | | pursuant to Patent Document 7 | conventional method |

Table 1 shows the results of the cases in which the mold width was constant. In Examples 1 to 3, the discharge directions were changed to 35%, 30% and 20%, respectively, by the ratio of the distance from the mold intersection point to the longer-side length. In the middle of the casting process, the molten metal flows on the mold surface were observed, while the discharge direction was changed by about ±5°. In either case, a stable rotational flow was obtained. In the mold, there were no changes in breakout occurrence indexes from those of the conventional methods, and the surface defect occurrence indexes resulted in low values in all the cases.

Comparative Example 1 shows a case in which the discharge direction is fixed at 45%, pursuant to Patent Document 1, where no rotational flow was generated. Further, the breakout occurrence index worsened. Although the surface defect occurrence index slightly decreased as compared with Comparative Example 7, its degree of decrease was not large.

Comparative Examples 2 to 4 show cases in which the initial discharge directions were the same as in Examples 1 to 3 but the discharge directions were not changed during casting. A rotational flow was successful in the initial stage but became increasingly unstable as the number of sequential continuous castings increased. The breakout index showed no change as compared with conventional methods. Although the surface defect occurrence index at the second charge in the initial stage of the casting showed small values, it tended to increase at the fifth charge. After casting, the asymmetric deposition of the inclusions was recognized inside the submerged nozzle. From this result, it was considered that drift flows occurred due to the asymmetrically deposited inclusions so that the rotation of the molten metal flow in the mold did not continue.

Comparative Example 5 shows a case in which the discharge direction was set to 10% in terms of the ratio of the distance from the mold intersection point to the longer-side length, while Comparative Example 6 is an example based on Patent Document 7. Although a rotational flow occurred, it could not be regarded as enough. Although the surface defect occurrence index slightly decreased as compared with Comparative Example 7, its degree of decrease was not large.

In Comparative Example 7, which is usually used, no rotational flow was obtained, and the surface defect occurrence index was higher than other examples.

TABLE 2

| | | Width change 1900-2300 mm | | | | | | | | | |
|---|---|---|---|---|---|---|---|---|---|---|---|
| | | Example 4 | Example 5 | Example 6 | Comparative Example 8 | Comparative Example 9 | Comparative Example 10 | Comparative Example 11 | Comparative Example 12 | Comparative Example 13 | Comparative Example 14 |
| Discharge direction | Intersection point between the discharge direction and the mold | longer side | longer side | longer side | longer side | longer side | longer side | longer side | longer side | shorter side | shorter side |
| | Distance from the mold intersection point (Ratio of the distance to the length of the longer side) | 35% | 30% | 20% | 46% | 38% | 34% | 26% | 18% | | |
| | Intersection point at the shorter side | | | | | | | | | center between thecenter of the shorter side and the intersection point | center of the shorter side |
| Whether the discahrge direction is variable or fixed | Variable Fixed | variable | variable | variable | fixed | fixed | fixed | fixed | fixed | fixed | fixed |
| Rotational flow | | ◎ | ◎ | ◎ | × | × | Δ | Δ | Δ | × | × |
| Breakout occurrence index | | 0.8 | 0.8 | 0.8 | 1.3 | 1.2 | 0.9 | 0.8 | 0.8 | 0.8 | 1.0 |

TABLE 2-continued

| | | Width change 1900-2300 mm | | | | | | | | | |
|---|---|---|---|---|---|---|---|---|---|---|---|
| | | Example 4 | Example 5 | Example 6 | Comparative Example 8 | Comparative Example 9 | Comparative Example 10 | Comparative Example 11 | Comparative Example 12 | Comparative Example 13 | Comparative Example 14 |
| Surface defect occurrence index | Second charge of sequential castings | 0.31 | 0.26 | 0.31 | 0.99 | 0.79 | 0.77 | 0.75 | 0.91 | 0.9 | 1.0 |
| | Fifth charge of sequential castings | 0.32 | 0.29 | 0.32 | 1.04 | 0.86 | 0.77 | 0.79 | 1.03 | 1.01<br>1.15 | 1.45<br>1.48 |
| Remarks | | | | | pursuant to Patent Document 1 | | | | | pursuant to Patent Document 7 | conventional method |

Table 2 shows the results after a width change in a case in which, after sequential continuous castings of five charges were performed using of the above-described mold having a width of 1900 mm, the mold width was changed from 1900 mm to 2300 mm.

As to the rotational flow described above, the results after the width change are shown, where the evaluation method is similar to that of Table 1. The breakout index was evaluated by a method similar to that of Table 1 in which the index of Comparative Example 7 was made to be 100. As to the surface defect occurrence index, those of the second and fifth charges after the width change were compared by a method identical to the evaluation method of Table 1 in which the index of Comparative Example 7 was made to be 100.

In the Examples, due to the width change, the discharge directions were changed to 35%, 30% and 20%, respectively, in terms of the ratio of the distance from the mold intersection point to the longer-side length. Thereafter, the adjustment of the angle by about ±5° was also performed. In this invention, a stable rotational flow was ensured, the breakout index showed no change compared with the conventional methods, and the surface defect occurrence index showed a lower value.

In contrast to this, Comparative Examples 8 to 17 show cases in which the width was changed under casting conditions of Comparative Examples 1 to 7, respectively. Since the discharge direction was fixed so as to remain 1900 mm of the width, the discharge direction also changed so as to increase the value of the angle relative to the longer side, along with changing the width to 2300 mm.

Comparative Examples 8 and 14 showed the results similar to those of Comparative Examples 1 and 7, where no sufficient rotational flow was obtained. In Comparative Examples 9 to 11, since a sufficient rotational flow was not obtained after the casting with 1900 mm of the width, the rotational flow was evaluated as Δ.

In Comparative Example 13, no rotational flow was obtained after the width change.

In cases where no sufficient rotational flow was obtained, the surface defect occurrence index resultantly increased along with increasing charge counts of the sequential continuous castings.

Consequently, it is apparent that the present invention is superior to the Comparative Examples.

INDUSTRIAL APPLICABILITY

The slab continuous casting apparatus according to the invention allows the submerged nozzle to be quickly replaced with another during sequential continuous castings and, moreover, to be rotatable integrally with the submerged-nozzle quick replacement mechanism which holds the submerged nozzle, by the drive mechanism, so that the discharge flow direction from the submerged nozzle can be arbitrarily changed during casting, making it possible to improve the quality of strands.

What is claimed is:

1. A slab continuous casting apparatus comprising:

a tundish for supplying molten metal to a water-cooled mold through at least an upper nozzle;

a slide valve disposed at a lower end of the upper nozzle, the slide valve comprising plat bricks;

a submerged nozzle having discharge holes configured to direct the molten metal in discharge directions toward a longer side of the water-cooled mold to obtain a rotational flow;

a submerged-nozzle quick replacement mechanism;

a discharge-direction changing mechanism capable of changing a discharge angle of the molten metal from the discharge holes in the submerged nozzle as viewed in a horizontal cross section, during casting; and a slide valve device for opening and closing the slide valve, the discharge-direction changing mechanism being provided between the slide valve device and the submerged nozzle, wherein the discharge-direction changing mechanism comprises a sliding-contact surface provided at least at an upper surface of the submerged nozzle, and a drive mechanism for changing the discharge directions of the molten metal from the submerged nozzle wherein the drive mechanism comprises:

a drive device for applying force for changing the discharge directions; and a transmission part for transmitting the force from the drive device to the submerged-nozzle quick replacement mechanism, wherein the submerged-nozzle quick replacement mechanism holding the submerged nozzle can be swung leftward and rightward about a center axis of the submerged nozzle by operating the drive device.

2. The slab continuous casting apparatus according to claim 1, wherein the water-cooled mold has a ratio of a length of a longer-side-wall to a length of a shorter-side-wall being equal to 5 or more.

3. The slab continuous casting apparatus according to claim 1, wherein the submerged-nozzle quick replacement mechanism comprises: bases; dampers supported by clamper pins provided on the bases; and springs provided on the bases to bias the clampers upward, wherein the clampers and the springs are a binary mechanism opposed to each other so as to form a 180° angle, and wherein the clampers support a flange lower surface of the submerged nozzle inserted along guide rails, the clampers being biased upward by the springs thereby holding and pressing upward the submerged nozzle.

4. The slab continuous casting apparatus according to claim 1, wherein an upper surface of the submerged nozzle is in sliding contact with a lower surface of a lowest plate brick of the slide valve device.

5. The slab continuous casting apparatus according to claim 1, further comprising a lower nozzle located under the slide valve device, wherein an upper surface of the submerged nozzle is in sliding contact with a lower surface of the lower nozzle.

* * * * *